US005114622A

United States Patent [19]

Funabashi et al.

[11] Patent Number: 5,114,622

[45] Date of Patent: May 19, 1992

[54] METHOD OF CEMENTING RADIOACTIVE WASTE AND CEMENTED BODY

[75] Inventors: Kiyomi Funabashi, Katsuta; Osamu Kuriyama, Hitachi; Koichi Chino, Hitachi; Tsutomu Baba, Hitachi; Takashi Nishi, Hitachi; Makoto Kikuchi, Hitachi, all of Japan

[73] Assignee: Hitachi, Ltd., Tokyo, Japan

[21] Appl. No.: 449,917

[22] PCT Filed: Apr. 28, 1989

[86] PCT No.: PCT/JP89/00451

§ 371 Date: Dec. 14, 1989

§ 102(e) Date: Dec. 14, 1989

[87] PCT Pub. No.: WO89/11149

PCT Pub. Date: Nov. 16, 1989

[30] Foreign Application Priority Data

May 2, 1988 [JP] Japan ..... 63-109512
Sep. 14, 1988 [JP] Japan ..... 63-228705

[51] Int. Cl.[5] ..... G21F 9/16

[52] U.S. Cl. ..... 252/629; 252/628; 252/633

[58] Field of Search ..... 252/628, 629, 633

[56] References Cited

U.S. PATENT DOCUMENTS 3,340,202 9/1967 Olombel et al. ..... 252/628
4,505,851 3/1985 Funabashi et al. ..... 252/628
4,661,291 4/1987 Yamasaki et al. ..... 252/629
4,725,383 2/1988 Hayashi et al. ..... 252/629
4,859,367 8/1989 Davidovits ..... 252/628

FOREIGN PATENT DOCUMENTS 62-267699 11/1987 Japan .
62-267700 11/1987 Japan .

*Primary Examiner*—Brooks H. Hunt
*Assistant Examiner*—Ngoclan T. Mai
*Attorney, Agent, or Firm*—Antonelli, Terry, Stout & Kraus

[57] ABSTRACT

The present invention relates to a method of cementing a radioactive waste and a cemented body thereof which are less liable to bring about radioactivity leakage for a long period of time and suitable for disposal of cemented bodies of radioactive wastes in the land.

The radioactivity leakage from a cemented body of a radioactive waste occurs due to the presence of the voids within the cemented body, and these voids are formed during hardening of the cemented body or by leaching of a soluble component from the cemented body during immersion in water.

In the present invention, in order to minimize the amount of radioactivity leakage, the fraction of fine voids (1 μm or less) is limited to 20% by volume or less. In order to attain such a void fraction, operating conditions, such as water to cement ratio, hardening time of a mixture of a solidifying material with a waste, and addition of an organic polymer, are properly determined.

Further, in order to prevent formation of a soluble component, i.e., $Ca(OH)_2$, the CaO content of the cement is limited to not less than $0.62 \times C_{SiO_2} + 0.27 \times C_{Al_2O_3}$ and not more than $1.87 \times C_{SiO_2} + 2.20 \times C_{Al_2O_3}$, wherein $C_{SiO_2}$ is the silicon content (% by weight) in terms of $SiO_2$ and $C_{Al_2O_3}$ is the aluminum content (% by weight) in terms of $Al_2O_3$.

13 Claims, 6 Drawing Sheets

METHOD OF CEMENTING RADIOACTIVE WASTE AND CEMENTED BODY

DESCRIPTION

1. Technical Field

The present invention relates to a method of cementing radioactive wastes and cemented bodies thereof, and more particularly to a method of cementing radioactive wastes and cemented bodies thereof which are less liable to bring about radioactivity leakage and suitable for disposal of cemented bodies of radioactive wastes in the land.

2. Background Art

As is well know, for stable storage and disposal, radioactive wastes generated in facilities handling radioactive substances, such as a nuclear power plant, should be solidifyed with a solidifying material into a container, thereby preventing radioactive substances from diffusing into the environment.

In recent years, sites for shallow land disposal of radioactive wastes have been decided, and the performance required of the solidified bodies of the radioactive wastes are clarifying, so that a specific measure such as legal regulation has been taken. According to this measure, assessment is made on the paths of migration of radioactive substances from the solidified bodies of radioactive wastes into the environment. Among the migration paths, particular importance has been attached to the path of migration into underground water by rainwater from the viewpoint of exposure of residents living in the periphery to the radioactive substances.

Specifically, solidified bodies of the radioactive wastes are buried in a concrete pit provided in a depth of 3 to 5 m of the disposal site. This enables the solidified bodies to be managed so that no radioactive substance will leak during the initial 50 years wherein the radioactivity level is high. For this period of time, the radioactivity level is lowered by disintegration of the radioactive substances. However, minute amounts of radioactive substances remain within solidified bodies of the radioactive wastes, which makes it necessary to reduce leakage of the radioactive substances. In the safety assessment, attention has been paid to the fact that when the solidified body is immersed in water, the radioactive substance leaks from the solidified body through the medium of water, and the safety assessment supposes immersion of the solidified body in water through penetration of rainwater into the pit.

In the conventional solidified bodies as well, the radioactivity leakage in the above-described state is so small that there occurs no problem. However, it has been desired to develop a method of solidifying a radioactive waste which further enhances the safety of the solidified body and can cope with the disposal of radioactive wastes having a high radioactivity level in the future.

In view of the above, novel solidification methods have been proposed. In these methods material is mainly composed of cement which is easy to solidify. One of these methods is described in Japanese Patent Laid-Open No. 215999/1986. This method comprises reducing the amount of water (a ratio of water to cement), when a cement-base solidifying material is mixed with water, for the purpose of suppressing the occurrence of voids derived from excess water.

In the case of cement, in order to maintain given fluidity, it is necessary to add water in an amount exceeding that consumed in the hardening reaction of the cement. This brings about formation of voids in the cement filled with the excess water. This phenomenon becomes a factor causative of permeation of water into the cement (or the voids serve as a path of leakage of radioactive substances from the cemented bodies when radioactive wastes are cemented). Cement having low water permeability has been developed for use in, among general industrial uses, applications such as floors of reservoirs and working spaces where permeation of water brings about a problem. Examples of this kind of cement include one containing a surfactant (a water reducing admixture) for the purpose of enhancing the fluidity of cement particles and one containing round particles having a size smaller than that of the cement particles (bearing effect). The cement described in the abovementioned Japanese Patent Laid-Open No. 215999/1986 corresponds to the latter one. Further, this publication describes that it is also effective to use an expanding admixture, such as calcined CaO, for the purpose of coping with voids remaining in a small amount.

As with the above-described prior art, cement having a bearing effect is described in Japanese Patent Laid-Open Nos. 267699/1987 and 267700/1987. These kinds of cement are used for different purposes and, besides attainment of the bearing effect, the amount of water added is reduced by adding an aggregate such as sand. However, the amount of water is large relative to the amount of the cement, and no attention is paid to the control of the excess water.

According to the findings of the present inventors, the above-described prior art has the two following problems.

(1) No description is found on the void fraction effective in controlling the radioactivity leakage in the cemented bodies of radioactive wastes. This is ascribable to the fact that merely cement for general industrial uses is applied to the disposal of radioactive wastes.

(2) The cement contains a soluble component which brings about occurrence of new voids during immersion of the cemented bodies in water. One of the prior art technologies describes that combined use of an expanding admixture comprising calcined CaO is effective in lowering the radioactivity leakage. However, this brings about formation of a soluble component.

Therefore, the prior art provides no solidifying agent for cementation of radioactive wastes having sufficient performance.

DISCLOSURE OF INVENTION

The present inventors have perceived that the radioactivity leakage from cemented bodies of radioactive wastes is attributable to the void fraction of the cemented bodies and the presence of soluble components in the cemented bodies, and an object of the present invention is to provide a method of solidifying radioactive wastes and cemented bodies thereof which serve to reduce the radioactivity leakage from a cemented body of a radioactive waste for a long period of time.

The above-described object can be attained by the following means.

The void fraction (porosity) is limited to 20% by volume for the purpose of minimizing the radioactivity leakage rate, and operating conditions such as the ratio of water to cement, hardening time of a mixture of a solidifying material with a waste, and addition of an organic polymer are properly determined so as to attain the above-described fraction value.

Further, in order to prevent formation of a soluble component $Ca(OH)_2$, the CaO content of the cement is limited to not less than $0.62 \times C_{SiO2} + 0.27 \times C_{Al2O3}$ and not more than $1.87 \times C_{SiO2} + 2.20 \times C_{Al2O3}$, wherein $C_{SiO2}$ is the silicon content (% by weight) in terms of $SiO_2$ and $C_{Al2O3}$ is the aluminum content (% by weight) in terms of $Al_2O_3$.

The present inventors have found that the radioactivity leakage from cemented bodies of radioactive wastes occurs due to the presence of the voids within the cemented bodies and that these voids are classified into those which are formed during hardening of the cemented bodies and those which are formed by leaching of a soluble component of the cemented bodies during immersion in water. Based on the above-described facts, the present inventors have newly found a void fraction capable of reducing the amount of radioactivity leakage from cemented bodies of radioactive wastes and enabled the radioactivity leakage rate to be maintained on a low level for a long period of time through prevention of formation in the cement of a soluble component which will be leached during immersion in water.

The radioactivity leakage from the cemented bodies through the voids is caused by formation of interconnected voids within solid bodies. Therefore, even when large voids are formed within the cemented bodies, no radioactivity leakage occurs as far as the voids are interconnected with each other. The present inventors have found that when fine voids (1 μm or less) are formed in a given amount, the formed voids are interconnected with each other, which brings about radioactivity leakage. Further, it has been found that the radioactivity leakage can be minimized by limiting the void ratio of hardened cement in a cemented body to 20% by volume or less (which prevents fine voids from being interconnected with each other). The following methods are thought to be effective in adjusting the void fraction. Specifically, the adjustment of the ratio of water to cement ensures water necessary for hardening the cement and, at the same time, prevents an increase in the void fraction caused by water. Further, the adjustment of the hardening time for a mixture of the solidifying material with wastes ensures a time necessary for eliminating air included in the cement during mixing and suppresses an increases in the void fraction. Further, the addition of an organic polymer serves to fill the remaining voids.

Formation of a soluble component in the cement can be prevented by adjusting the CaO content of the cement. Specifically, the adjustment of the CaO content of the cement enables $SiO_2$ and $Al_2O_3$ as the main components of the cement to react with soluble $Ca(OH)_2$ formed through hydration of CaO, thereby forming insoluble $CaO\text{-}SiO_2\text{-}H_2O$ and $CaO\text{-}Al_2O_3\text{-}H_2O$ gels. This enables prevention of formation of a soluble component in the cement, so that it is possible even during immersion in water to prevent occurrence of voids which enhance the radioactivity leakage.

BEST MODE FOR CARRYING OUT THE INVENTION

The results of two fundamental experiments which have led to the present invention will now be described.

Figure 1:
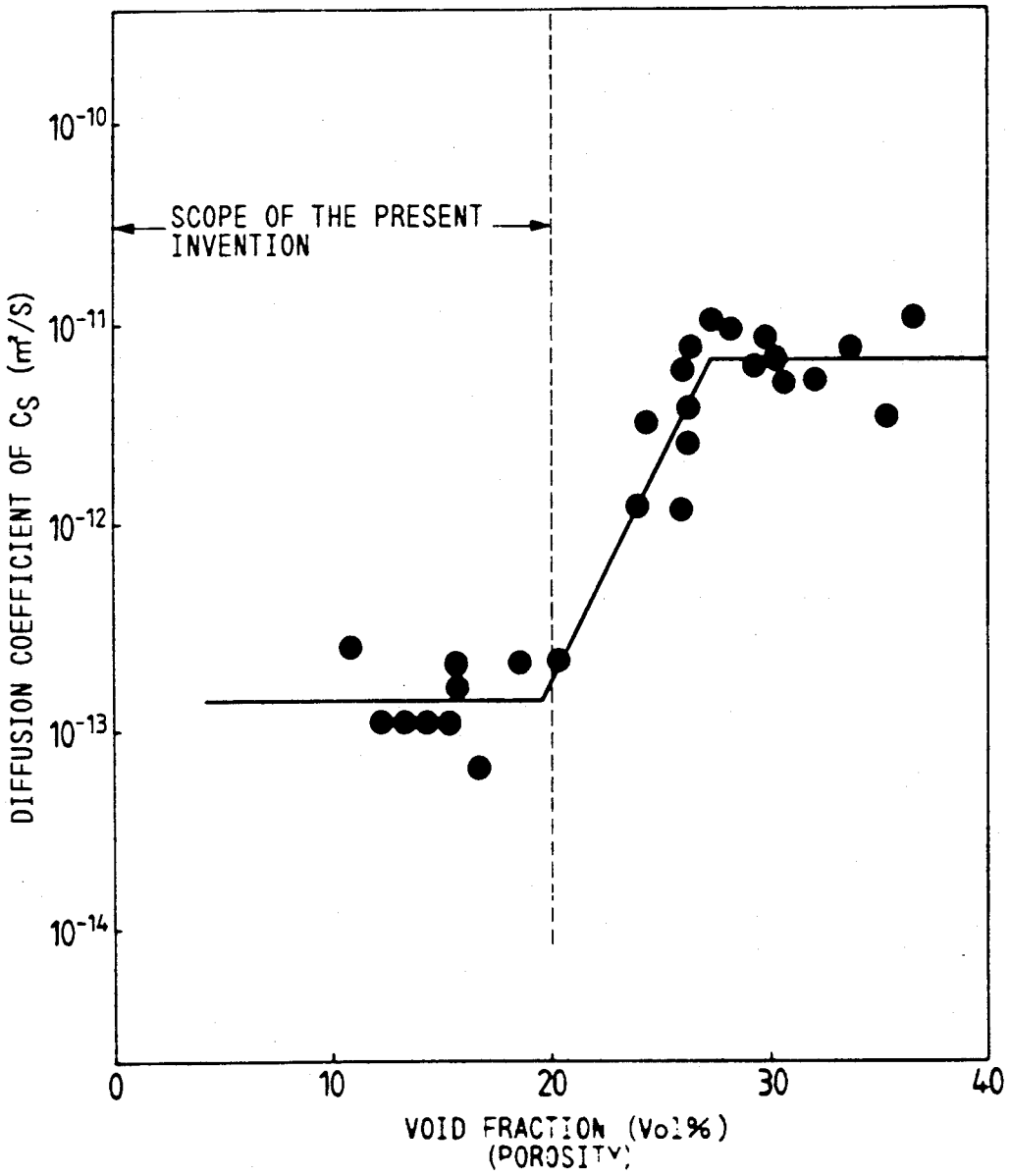
FIG. 1 is a graph showing the results of a fundamental experiment conducted for determining void fraction conditions required of a cemented body of a radioactive waste.

First, the results of a fundamental experiment conducted for determining void fraction conditions required of a cemented body of a radioactive waste will be described. FIG. 1 shows the results of the fundamental experiment. In the experiment, hardened bodies of cement having different void fractions were prepared by adjusting the water to cement ratio and the amount of addition of an organic polymer. In preparing the hardened bodies, cement was kneaded in a predetermined water to cement ratio and amount of addition of an organic polymer and cured at 20° C. for 28 days in a hermetically sealed state. A disk having a size of $50\phi \times 5$ mm in thickness was prepared therefrom. One surface of the disk was brought into contact with a solution containing radioactive $^{134}Cs$, while the other surface with pure water. Thus, the amount of radioactivity which had leaked into the pure water was measured, and the diffusion coefficient of the hardened body of cement was finally calculated. The higher the diffusion coefficient, the higher the tendency of the radioactivity to leak from the hardened body. Mercury porosimetry and Archimedes' method are employed to measure the amount of voids having a pore diameter of 1 μm or less which participate in the radioactivity leakage, and the void fraction was calculated from the amount of voids. Specifically, the volume of voids having a pore diameter larger than 1 μm was determined by the mercury porosimetry, and the total amount of voids was determined by the Archimedes' method. The amount of voids having a pore diameter larger than 1 μm determined by the mercury porosimetry was subtracted from the total amount of voids determined by the Archimedes' method to determine the amount of voids having a pore diameter of 1 μm or less, and the void fraction of the hardened body of cement was calculated from the amount of the voids. As is apparent from FIG. 1, when the void fraction exceeds 20% by volume, the diffusion coefficient is increased and the radioactivity leaks readily. Therefore, in order to prepare cemented bodies of radioactive wastes having low susceptibility to radioactivity leakage the void fraction of the hardened body of cement as the solidifying material should be limited to 20% by volume or less.

Figure 2:
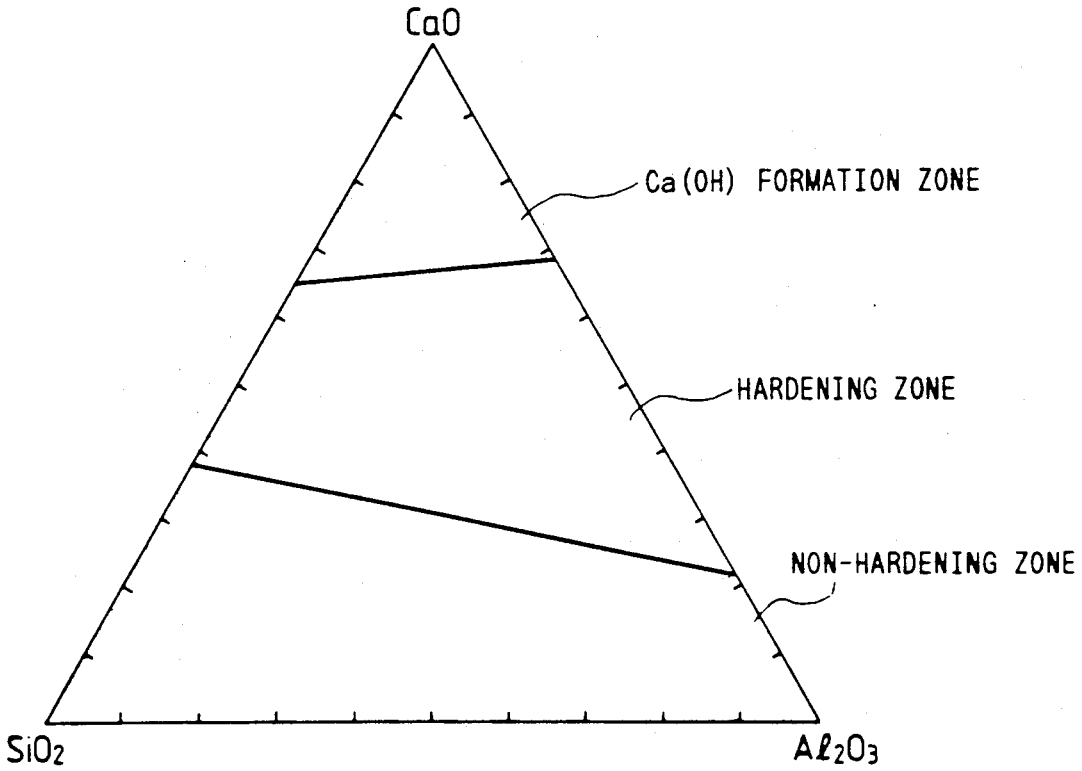
FIG. 2 is a graph showing the results of a fundamental experiment conducted for determining the CaO content of cement.

Next, the reason for determination of the CaO content of the cement will be described with reference to the results of another fundamental experiment. FIG. 2 is a phase diagram of a ternary $CaO\text{-}SiO_2\text{-}Al_2O_3$ system showing the range of formation of $Ca(OH)_2$ as a soluble component and the range of hardening. In this case, in order to vary the CaO, $SiO_2$ and $Al_2O_3$ contents, commercially available cements different from each other in the contents of these components were used. Water was added to the cement so as to adjust the water to cement ratio to 0.19, and an organic polymer comprising a styrene-butadiene copolymer was added in an amount of 5 parts by weight per 100 parts by weight of cement, thereby hardening the cement. The thermogravimetric change of the hardened body was measured by making use of a thermobalance, and the amount of formation of $Ca(OH)_2$ was determined from the reduction in the weight at a temperature at which $Ca(OH)_2$ is decomposed into CaO and $H_2O$. As a result, it has been found that there exists a region wherein the amount of formation of $Ca(OH)_2$ is rapidly increased depending upon cement components. A range shown in FIG. 2 was determined from the experimental value thus obtained and thermodynamic chemical equilibrium calculation. When the amount of CaO is small, there exists a range wherein no hardening occurs (a range wherein a predetermined shape cannot be maintained when the hardening reaction has been completed). This is because cement is hardened by the following reaction (when the $SiO_2$ content is high) and formation of $Ca(OH)_2$ is essential to the hardening of the cement:

$$CaO + H_2O \rightarrow Ca(OH)_2$$

$$Ca(OH)_2 + SiO_2 \rightarrow CaO\text{-}SiO_2\text{-}H_2O \text{ gel}$$

However, when the CaO content is increased, the resultant $Ca(OH)_2$ remains as it is in the hardened body of cement.

The range shown in FIG. 2 falling within the scope of the present invention is represented by the following formulae:

$$C_{CaO} > 0.62 \cdot C_{SiO_2} + 0.27 \cdot C_{Al_2O_3}$$

and $$C_{CaO} < 1.87 \cdot C_{SiO_2} + 2.20 \cdot C_{Al_2O_3}$$

wherein Ccao is the calcium content (% by weight) in terms of CaO, $C_{SiO_2}$ is the silicon content (% by weight) in terms of $SiO_2$, and $C_{Al_2O_3}$ is the aluminum content (% by weight) in terms of $Al_2O_3$.

Although the cement also contains miner amounts of other components besides the three components, i.e., calcium (CaO), silicon ($SiO_2$), and aluminum ($Al_2O_3$), above-described contents (% by weight) of CaO, $SiO_2$ and $Al_2O_3$ are those determined by supposing the sum of the weights of CaO, $SiO_2$ and $Al_2O_3$ to be 1.

As is apparent from the foregoing description, in order to prepare cemented bodies of radioactive wastes less liable to bring about radioactivity leakage, it is necessary to adjust the CaO content of the cement as a solidifying material to full in a specified range.

As is apparent from the above results, in order to prepare cemented bodies of radioactive wastes less liable to bring about radioactivity leakage, it is necessary to adjust the CaO content of the cement as a solidifying material to fall in the range shown in FIG. 2 and to limit the void fraction of the hardened body of the cement to 20% by volume or less.

Particular conditions for preparing the abovedescribed cemented bodies of radioactive wastes less liable to bring about radioactivity leakage and effects thereof will now be described in detail with reference to the accompanying drawings as the example.

Figure 3:
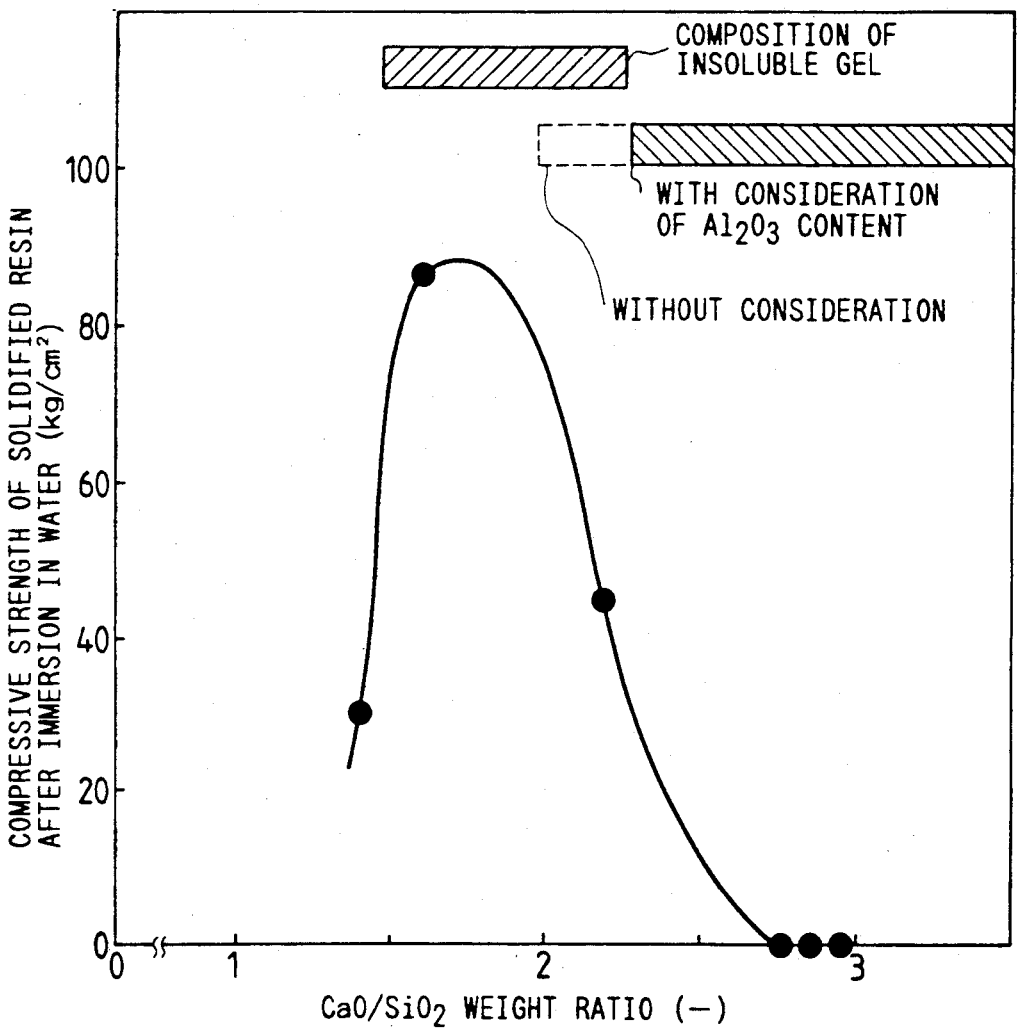
FIG. 3 is a graph showing the strength of the cemented body of the present invention after immersion in water.

First, the strength of a cemented body during immersion in water was measured in order to examine a specific effect attained by adjusting the CaO content of cement as a solidifying material so as to fall in a range shown in FIG. 2. FIG. 3 is a graph showing the compressive strength of a cemented body of an ion exchange resin after immersion in water for 30 days. In this case, the ion exchange resin was solidified by using commercially available cement having an $Al_2O_3$ content as low as 20% by weight or less and a CaO content falling in the range shown in FIG. 2, adding water to the cement so as to adjust a water to cement ratio to 0.19 and, at the same time, adding an organic polymer comprising a styrenebutadiene copolymer emulsion in an amount of 5 parts by weight per 100 parts by weight of the cement, mixing them, and adding to the mixture a resin having a water content of 50% by weight in an amount of 20% by weight on a dry weight basis to conduct cementation. The cemented body thus prepared was immersed in water at 20° C. for 30 days to measure the compressive strength. Since the cement has a low $Al_2O_3$ content in this case, the results of measurement of the compressive strength are shown in FIG. 3 as a function of the content ratio of the main components, i.e., the CaO to $SiO_2$ content ratio. As can be seen from FIG. 3, cemented bodies having high strength can be prepared when the CaO to $SiO_2$ ratio is 1.5 to 2.3, particularly 1.5 to 2. When this ratio is below the above lower limit, there occurs a deviation from the composition range of an insoluble $CaO\text{-}SiO_2\text{-}H_2O$ formed by the hardening of the cement, so that it becomes impossible for the hardening of the cement per se to proceed. For the following reason, the higher the strength of a cemented body, the smaller the amount of radioactivity leakage. Since the ion exchange resin waste used in the above example has capability of expanding as a result of absorption of water when the cemented body is immersed in water, the ion exchange resin is expanded as a result of absorption of water, which brings about damage to the cemented body and lowering in the strength thereof. Therefore, the presence of a water passage in the cemented body causes water to easily pass through the cemented body and radioactive substances to easily leak.

Consequently, it has been confirmed that cemented bodies less liable to bring about radioactivity leakage can be prepared by adjusting the CaO content of cement as a solidifying material to the range shown in FIG. 2. Further, it has been found that there exists a lower limit of the CaO content from the viewpoint of the hardening of the cement.

Two specific examples, i.e., adjustment of the water to cement ratio and that of the hardening time, will now be described as the method of adjusting the void fraction.

First, the method of adjusting the void fraction through adjustment of the water to cement ratio will be described. In this case, as an example of the present invention, hardened bodies of cement only were prepared by making use of commercially available cement having CaO, $SiO_2$ and $Al_2O_3$ contents of 49, 30 and 11% by weight, respectively, and the water to cement ratio as a parameter. A styrene-butadiene copolymer emulsion was added as an organic polymer according to need. The results are indicated by closed circles in FIG. 4. It is apparent from FIG. 4 that the void fraction has a substantially linear relationship with the water to cement ratio and can be lowered to 20% or less by limiting the water to cement ratio to less than 0.2. Further, in the case of cement having a high $SiO_2$ content, the hydrate is mainly $4CaCO{\cdot}3SiO_2{\cdot}3/2H_2O$. When the cement is assumed to be completely converted into the above hydrate, the water to cement ratio in this case can be calculated from $(3/2H_2O)/(CaO{\cdot}3SiO_2)$ and is 0.17. This value is in well agreement with the water to cement ratio in the case of a void fraction of 20%.

Figure 4:
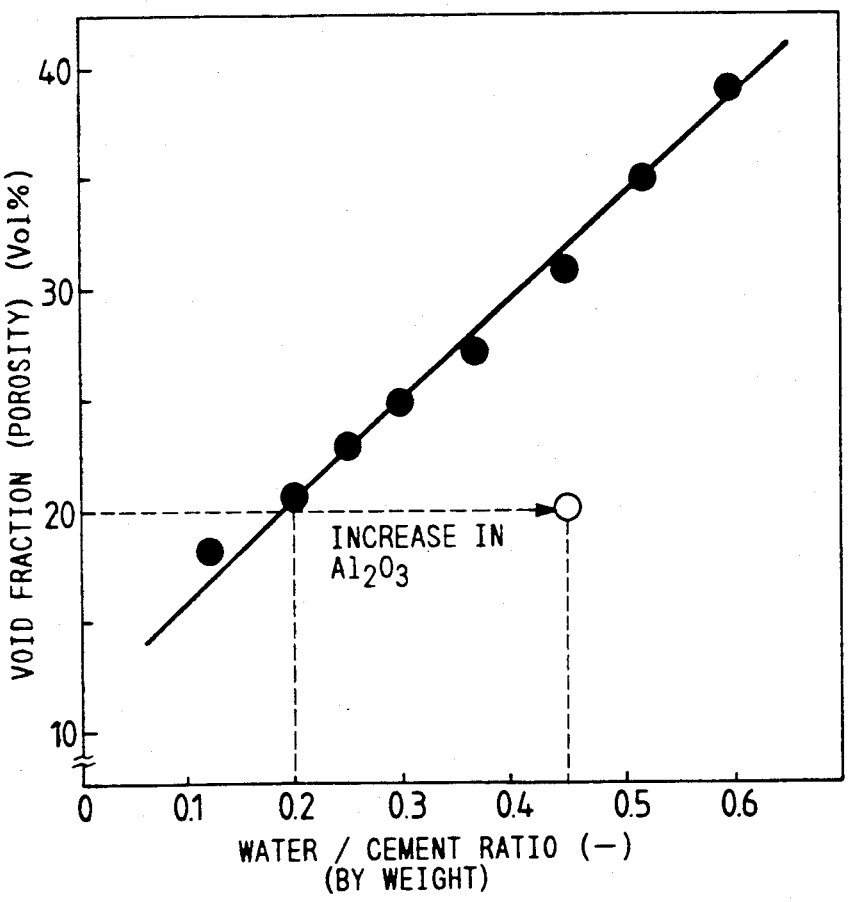
FIG. 4 is a graph showing the relationship between the void fraction and the ratio of water to cement.

On the other hand, when the $Al_2O_3$ content is 50% by weight or more, a different kind of product is formed by the hardening of cement, so that as indicated by an open circle in FIG. 4, the water to cement ratio capable of providing a void fraction of 20% is different from the above case. In this case, since the water to cement ratio could not be experimentally determined due to rapid progress of the hardening of the cement, it was determined by the following method. Specifically, as with the calculation in the case of a high $SiO_2$ content, when the $Al_2O_3$ content is high, the hydration can be expressed by the following formula:

$$3(CaO{\cdot}Al_2O_3) + 12H_2O \rightarrow 3CaO{\cdot}Al_2O_3{\cdot}6H_2O + 4Al(OH)_3$$

In this case, the water to cement ratio can be calculated from $12H_2O/(CaO{\cdot}Al_2O_3)$ and is 0.45. Therefore, it is apparent in the case of cement having an $Al_2O_3$ content as high as 50% by weight or more that a void fraction of 20% or less can be attained by limiting the water to cement ratio to 0.45 or less.

Figure 5:
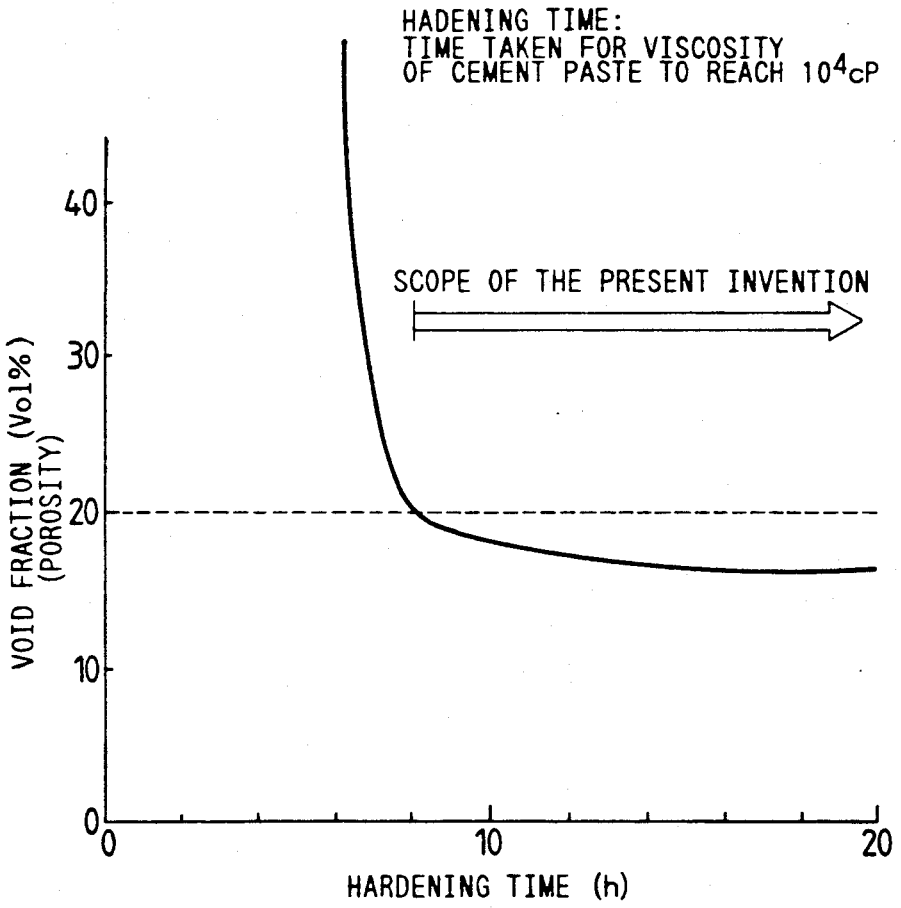
FIG. 5 is a graph showing the relationship between the hardening time and the void fraction.

The relationship between the hardening time and the void fraction will now be described. This relationship is shown in FIG. 5. In this drawing, the void fraction of cemented bodies of sodium sulfate pellets and ion exchange resin as radioactive wastes are shown based on the hardening time of cement in a state containing no waste (but containing admixtures such as polymer additive and additive known as an aggregate in the art). As can be seen from FIG. 5, the longer the hardening time, the lower the void fraction. This is because when the hardening time is short, the air included during mixing of cement or pouring of cement in a container for a cemented body lowers the void fraction. When radioactive wastes are solidified, the hardening time is $\frac{1}{3}$ to $\frac{1}{4}$ of that of cement only, which makes it difficult to remove the included air. Therefore, it takes 8 hr or more to attain a void fraction of 20% by volume or less necessary for cemented bodies of radioactive wastes based on the hardening time taken for solidifying cement only. On the other hand, an increase in the $Al_2O_3$ content shortens the hardening time and brings about a deviation from the scope of the present invention. In order to prevent this phenomenon, it is necessary to use $Al_2O_3$ in combination with a retarding admixture. Examples of the admixture include gypsum, carbohydrates such as sugar, silicofluorides (hexafluorophosphates), acids such as tartaric, humic, ligninsulfonic, boric and phosphoric acids and their salts, and zinc oxide.

Thus, the void fraction is adjusted to 20% by volume or less intended in the present invention.

Figure 6:
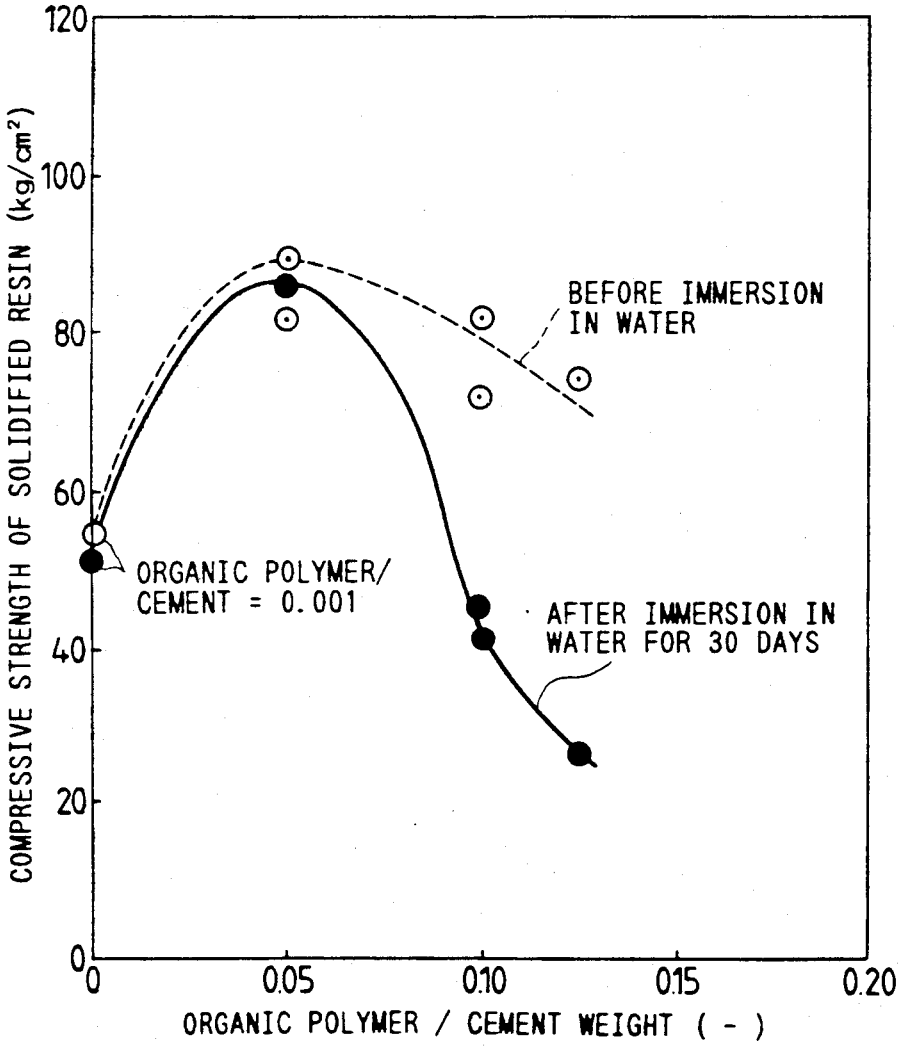
FIG. 6 is a graph showing the strength of the cemented body of the present invention before and after immersion in water as a function of the amount of addition of an organic polymer.

In order to demonstrate specific effects of the present invention, cemented bodies were prepared based on the above results and subjected to measurement of the strength during immersion in water. FIG. 6 shows the results of measurement of the compressive strength before and after-immersion in water on the cemented body of an ion exchange resin waste. As an example of the present invention, an ion exchange resin was solidified by making use of commercially available cement having a CaO content falling in the range shown in FIG. 2 and CaO, $SiO_2$ and $Al_2O_3$ contents of 49, 30 and 11% by weight, respectively, under conditions of a water to cement ratio of not less than 0.13 and not more than 2 and as a parameter the amount of addition of an organic polymer comprising a styrene-butadiene copolymer emulsion. The ion exchange resin was added in the form of a hydrous resin having a water content of 50% by weight so as to have a resin content of 20% by weight in terms of the dry weight. As is apparent from FIG. 6, when the amount of addition of the organic polymer is 0.001 to 0.15, the cemented body of the present invention has sufficient strength even after immersion in water. Further, for the reasons set out above, it is apparent that the radioactivity leakage is also small. When attention is paid to an organic polymer, it is apparent that the addition of the organic polymer brings about significant effects. Examples of the effects of the organic polymer include that of enhancing the fluidity between cement particles and that of filling the voids remaining in the cement after hardening. When the amount of addition of the organic polymer is in the above-described range, i.e., 0.001 to 0.15, the diffusion coefficient of the cement is in the range on the left side in FIG. 1 and smaller than that of the conventional cement. Therefore, it is possible to attain the effect of controlling the radioactivity leakage through a combination of the organic polymer with the above-described limitation of the CaO content which could not be attained in the prior art.

The present invention can be modified as follows without limitation to the above-described Examples.

Although commercially available cement having a CaO content falling in the range shown in FIG. 2 was used in the above examples, it is also possible to add substances having high $SiO_2$ and $Al_2O_3$ contents and a latent hydraulic property, i.e., fly ash, slag, pozzolan, etc., to cement having a high CaO content. This substance exhibits a hydraulic property when being brought into contact with $Ca(OH)_2$ formed by the hydration of cement and is found in a portion of a relatively high CaO content in the non-hardening zone shown in FIG. 2. Therefore, no aggregate such as sand is contained therein. Although it is preferred to adjust the CaO content through addition of these substances in the stage of production in plants, the adjustment may be conducted when the cement is used.

Further, it is noted that the CaO content of cement may be outside the range shown in FIG. 2 as far as no calcium oxide as a soluble component is formed. Specifically, use may be made of phosphate cement etc. wherein none of CaO, $SiO_2$ and $Al_2O_3$ constitute the main component.

In the above-described examples, ion exchange resin particles were mainly used as a radioactive waste. However, the same effect can be attained when the present invention is applied to other wastes, e.g., sodium sulfate pellets, incineration ash pellets, and sodium borate pellets. Further, the present invention can be applied to homogeneous solidification wherein cement and radioactive wastes are homogeneously mixed with each other for solidification. However, in the case of sodium sulfate and sodium borate, these wastes are readily soluble, so that voids are formed as a result of dissolution of the wastes during immersion in water, which lowers the effects of the present invention. Therefore, in the case of homogeneous solidification, the present invention is useful for wastes, such as ion exchange resins, which are insoluble in water.

Although the emulsion of a styrene-butadiene copolymer was used in the above examples, the present invention is not limited to this polymer emulsion only. Examples of other polymer emulsions which can be used in the present invention include emulsions prepared by suspending polymers, such as polyvinyl propionate, polyvinyl acetate or polyvinyl butyrate, in water.

The organic polymer may be a water-soluble substance, and examples thereof include a salt of polyalkylsulfonic acid, a salt of a condensate of paphthalenesulfonic acid with formaldehyde, a salt of a condensate of melaminesulfonic acid with formaldehyde, a salt of high-molecular weight ligninfulfonic acid, a salt of polycarboxylic acid, and a polyhydric alcohol. The effect can be enhanced by using these water-soluble organic polymers in combination with the above-described polymer emulsions. Although it is also possible to use these water-soluble organic polymers alone, the effect is smaller than that attained by the above-described emulsions.

According to the present invention, it is possible to provide a cemented body which is less liable to bring about radioactivity leakage for a long period of time. Further, an increase in the amount of radioactivity leakage can be prevented during immersion in water.

What is claimed is:

1. A method of cementing a radioactive waste, comprising:

preparing a cement the main oxide components of which are calcium oxide (CaO), silicon oxide ($SiO_2$) and aluminum oxide ($Al_2O_3$), and in which a calcium oxide component content is in a range expressed by the following formulae:

$$C_{CaO} > 0.62 \cdot C_{SiO_2} - 0.27 \cdot C_{Al_2O_3}$$

and $$C_{CaO} > 1.87 \cdot C_{SiO_2} - 2.20 \cdot C_{Al_2O_3}$$

wherein $C_{CaO}$ is the calcium oxide component content (% by weight);

$C_{SiO_2}$ is the silicon oxide component content (% by weight);

$C_{Al_2O_3}$ is the aluminum oxide component content (% by weight); and $C_{CaO}+C_{SiO_2}+C_{Al_2O_3}=100\%$ mixing the cement with water;

hardening the cement mixed with water with a radioactive waste in such a manner that a hardened body of said cement has a void fraction (porosity) of 20% by volume or less.

2. A method of cementing a radioactive waste according to claim 1, wherein, during mixing of the cement, the cement is mixed with the water in a water to cement ratio of less than 0.2 as to adjust the void fraction (porosity) to 20% by volume or less.

3. A method of cementing a radioactive waste according to claim 1, wherein during preparing of the cement, a cement having an $Al_2O_3$ content of 50% by weight is obtained and during mixing the cement is mixed with the water in a water to cement ratio of less than 0.45 to adjust the void fraction (porosity) to 20% by volume or less.

4. A method of cementing a radioactive waste according to claim 1, wherein, during hardening of the cement, the cement hardened in a hardening time of 8 hr or more to adjust the void fraction (porosity) to 20% by volume or less.

5. A method of cementing a radioactive waste according to claim 1, wherein, during mixing of the cement, the cement is mixed with the water in a water to cement ratio of less than 0.2 and during hardening of the cement, the cement hardens in a hardening time of 8 hr or more to adjust the void fraction (porosity) to 20% by volume or less.

6. A method of cementing a radioactive waste, comprising:

preparing a cement the main oxide components of which are calcium oxide (CaO), silicon oxide ($SiO_2$) and aluminum oxide ($Al_2O_3$), and in which a calcium oxide component content is in a range expressed by the following formulae:

$$C_{CaO} > 0.62 \cdot C_{SiO_2} - 0.27 \cdot C_{Al_2O_3}$$

and $$C_{CaO} > 1.87 \cdot C_{SiO_2} - 2.20 \cdot C_{Al_2O_3}$$

wherein $C_{CaO}$ is the calcium oxide component content (% by weight);

$C_{SiO_2}$ is the silicon oxide component content (% by weight);

$C_{Al_2O_3}$ is the aluminum oxide component (% by weight); and $C_{CaO}+C_{SiO_2}+C_{Al_2O_3}=100\%$ (by weight).

mixing the cement with water, and hardening the cement mixed with water with a radioactive waste in such a manner that a hardened body of said cement has a void fraction (porosity) of 20% by volume or less in terms of a void having a pore diameter of 1 μm or less.

7. A method of cementing a radioactive waste according to claim 4 or claim 5, further comprising adding a retarding admixture to the cement whereby during hardening of the cement the cement hardens in a hardening time of 8 hr or more.

8. A method of cementing a radioactive waste according to claim 1 or claim 6, wherein the radioactive waste admixed with the cement mixed with water is in particulate form.

9. A cemented body of a radioactive waste, comprising:

a container;

a radioactive waste particles charged in said container; and a hardened body of a cement filling gaps formed among the radioactive waste particles, the main oxide components of which are calcium oxide (CaO), silicon oxide ($SiO_2$) and aluminum oxide ($Al_2O_3$), and in which a calcium oxide component content is in a range expressed by the following formulae and a void fraction (porosity) of 20% by volume or less:

$$C_{CaO} > 0.62 \times C_{SiO_2} + 0.27 \times C_{Al_2O_3}$$

and $$C_{CaO} < 1.87 \times C_{SiO_2} + 2.20 \times C_{Al_2O_3}$$

wherein $C_{CaO}$ is the calcium oxide component content (% by weight)

$C_{SiO_2}$ is the silicon oxide component content (% by weight);

$C_{Al_2O_3}$ is the aluminum oxide component content (% by weight; and $C_{CaO}+C_{SiO_2}+C_{Al_2O_3}=100\%$.

10. A method of cementing a radioactive waste according to claim 1 or claim 6, further comprising, prior to hardening of the cement, adding an organic polymer to the cement in an amount such that the weight ratio of the organic polymer to the cement is 0.01 to 0.15

11. A method of cementing a radioactive waste according to claim 10, wherein the organic polymer comprises a styrenebutadiene copolymer emulsion.

12. A cemented body of a radioactive waste according to claim 9, wherein the hardened body further contains an organic polymer, the weight ratio of the organic polymer to the cement being 0.01 to 0.15.

13. A cemented body of a radioactive waste according to claim 12, wherein said organic polymer comprises a styrenebutadiene copolymer emulsion.

* * * * *